US007243698B2

(12) United States Patent
Siegel

(10) Patent No.: US 7,243,698 B2
(45) Date of Patent: Jul. 17, 2007

(54) PLEATED SHADE WITH SEWN IN PLEATS

(75) Inventor: Leonard Siegel, New York, NY (US)

(73) Assignee: ITA, Inc., Palm Coast, FL (US)

( * ) Notice: Subject to any disclaimer, the term of this patent is extended or adjusted under 35 U.S.C. 154(b) by 150 days.

(21) Appl. No.: 11/032,818

(22) Filed: Jan. 10, 2005

(65) Prior Publication Data

US 2006/0151127 A1 Jul. 13, 2006

(51) Int. Cl.
*A47H 5/00* (2006.01)

(52) U.S. Cl. ..... 160/84.04

(58) Field of Classification Search ..... 160/84.04, 160/84.05, 84.06, 84.01, 348, 124, 126, 330, 160/DIG. 7

See application file for complete search history.

(56) References Cited

U.S. PATENT DOCUMENTS 3,478,805 A * 11/1969 Haggard ..... 160/5
3,777,800 A * 12/1973 Susoev ..... 160/84.04
4,974,656 A 12/1990 Judkins
5,168,912 A 12/1992 Jelic et al.
5,566,735 A 10/1996 Jelic
5,620,035 A * 4/1997 Judkins ..... 160/84.05
5,690,156 A * 11/1997 Ruggles ..... 160/84.04
5,862,850 A * 1/1999 Yang ..... 160/84.04
6,257,300 B1 * 7/2001 Brownlie ..... 160/84.01
6,347,658 B1 2/2002 Judkins
6,817,399 B2 * 11/2004 Berman et al. ..... 160/84.04
2004/0020604 A1 * 2/2004 Allsopp ..... 160/84.04

* cited by examiner

*Primary Examiner*—David Purol
(74) *Attorney, Agent, or Firm*—Buchanan Ingersoll & Rooney PC

(57) ABSTRACT

A pleated shade with sewn in pleats is provided, in which each pleat is formed by a seam. Preferably, the seams that form pleats in the front side of the material separate only a few threads of the fabric from the main portions of the pleat. The seams that form pleats in the back surface of the panel preferably form a large tab of approximately one fourth of an inch which opens to create a pocket adjacent each seam. A stiff or flexible rod is placed in each pocket. Lift cords and spacer cords are attached to the larger rear tabs by clips.

25 Claims, 2 Drawing Sheets

PLEATED SHADE WITH SEWN IN PLEATS

FIELD OF THE INVENTION

This invention relates generally to a pleated shade, and more particularly to a pleated shade wherein some of the pleats have a tab.

BACKGROUND OF THE INVENTION

In a standard pleated shade construction, a piece of material having a front side and a back side is pleated into a plurality of horizontal sections which stack one on top of the other when the shade is in its raised position. Alternate pleats face toward the front side or the rear side of the shade. Each section has at least one hole punched preferably through the transverse center thereof which holes are aligned when the shade is folded. Normally, there would be two or more aligned rows of holes formed in the shade sections. Lift cords passing through the aligned holes are utilized to control the raising and lowering of the shade and also control the folding of the pleat.

U.S. Pat. No. 4,974,656 discloses a pleated shade construction in which tabs are formed on the pleats on the rear of the shade. The tabs are formed by securing together the two sections of material forming each of the back projecting pleats along substantially the entire width of the material to form a tab of approximately five sixteenths to three eights of an inch projecting from the rear of each of such pleats. The sections may be secured together by welding, gluing, sewing or other suitable means. The lift cords are threaded through holes in the tabs which does not result in cords and holes being visible from the front of the shade. The rear projecting tabs permit two sections of pleated shade to be easily and invisibly spliced together at the tab. The rigidity of the pleats may be enhanced by providing a double-weld joint for the tab or by otherwise providing a multiple or continuous bond between the two fabric layers forming the tab. The joints used to form the tabs may be used as splice joints to secure together two pieces of shade material.

The pleated fabric disclosed in U.S. Pat. No. 4,974,656 and other prior art pleated shades typically exhibit a rectilinear or "hard" appearance, due in part to the material used to make the shade which is coated to hold the permanent creases and also due in part to the method of manufacture. Conventional methods of constructing the pleated material for a simple, single pleat type of shade involve either creasing the entire length of material at regular intervals, or creasing portions of material and creating tabs which may be joined together to form, or repair, a shade from more than a single piece of material. The "hard" appearance generally results because the creases or the tabs used to form the pleats are continuous along the entire width of the shade material and very straight, even sharp. Furthermore, there are some materials such as lace which are difficult to pleat because the weave is so open that there is not enough material to retain pleat retention coatings. There are also some fabrics that can discolor when ironed or coated to create or maintain pleats.

Consequently, there is a need for a pleated material which has a "softer," more textured appearance than conventional pleated shades. There is also a need for a pleat that can be formed in lace and other fabrics without using ironing and coatings to create and maintain the pleats.

SUMMARY OF THE INVENTION

A pleated shade with sewn in pleats is provided, in which each pleat is formed by a seam. Preferably, the seams that form pleats in the front side of the material separate only a few threads of the fabric from the main portions of the pleat. The seams that form pleats in the back surface of the panel preferably form a large tab of approximately one fourth of an inch which opens to create a pocket adjacent each seam. A stiff or flexible rod is placed in each pocket. Lift cords and spacer cords are attached to the larger rear tabs by clips.

The seams that form the front pleats may be loose so that the portions of the fabric immediately adjacent to the seam do not touch one another when the pleated material is in a fully extended position. The pleated material can be part of a window shade that includes the typical pleated shade components such as a headrail and a bottomrail, to which the top and bottom of the pleated fabric, respectively, are connected.

Preferably a soft material of the type used for a drapery is used. Such material will have smoother, fuller contours than stiffer materials.

Other details, objects, and advantages of the invention will become apparent from the following detailed description and the accompanying drawings of certain embodiments thereof.

DETAILED DESCRIPTION OF THE PREFERRED EMBODIMENTS

Figure 1:
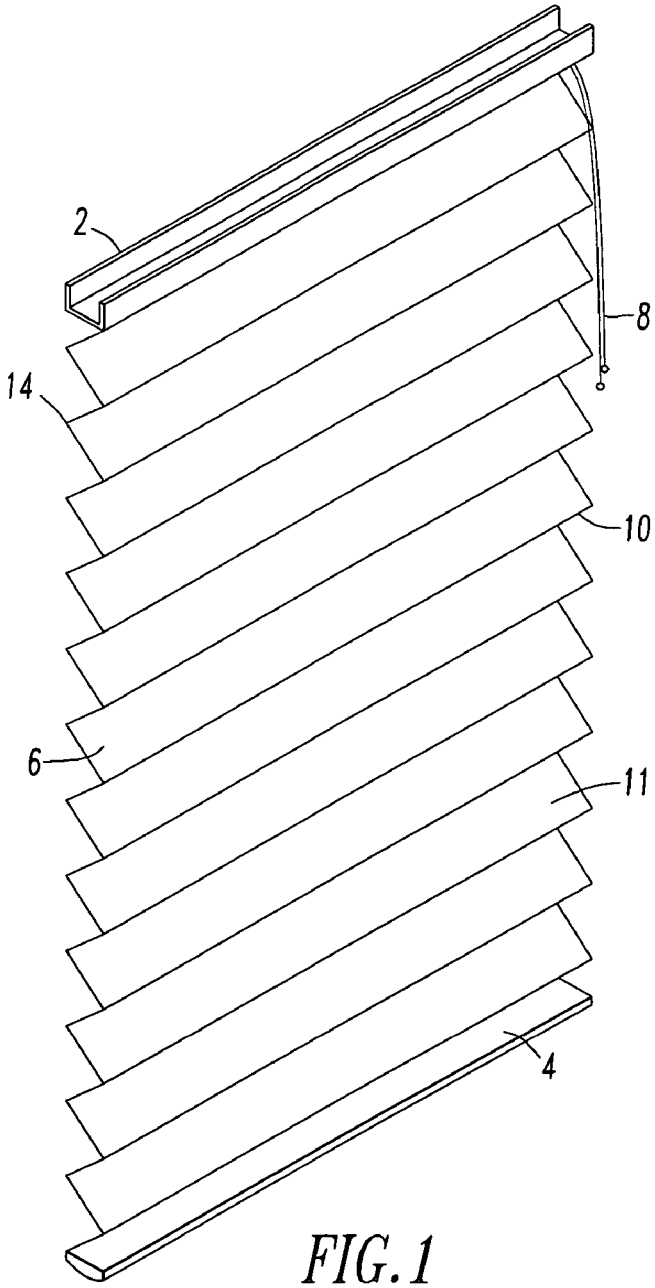
FIG. 1 is a front perspective view of a pleated shade of a first embodiment of the invention having sewn in pleats and tabs.
Figure 2:
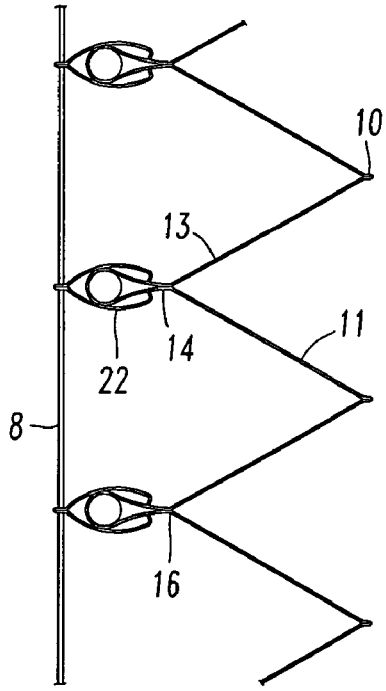
FIG. 2 is a side view of the portion of the embodiment shown in FIG. 1.
Figure 3:
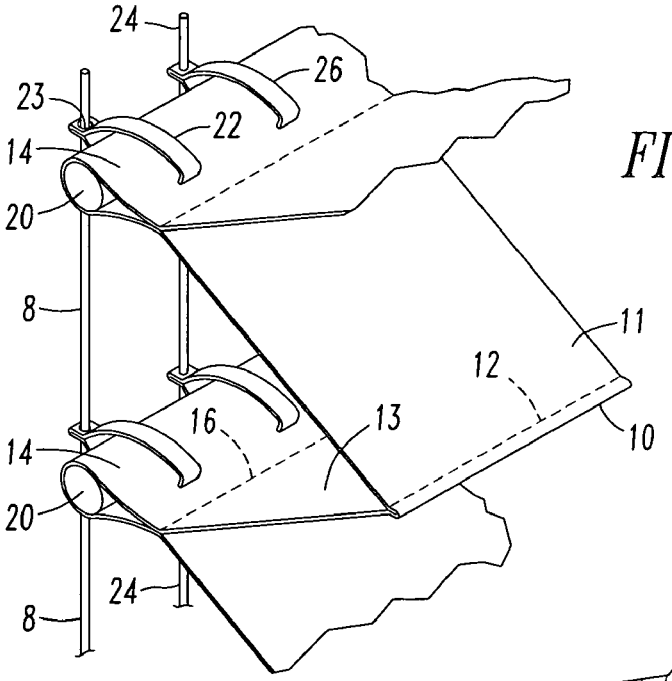
FIG. 3 is a perspective view of a portion of the pleated shade shown in FIG. 2.
Figure 4:
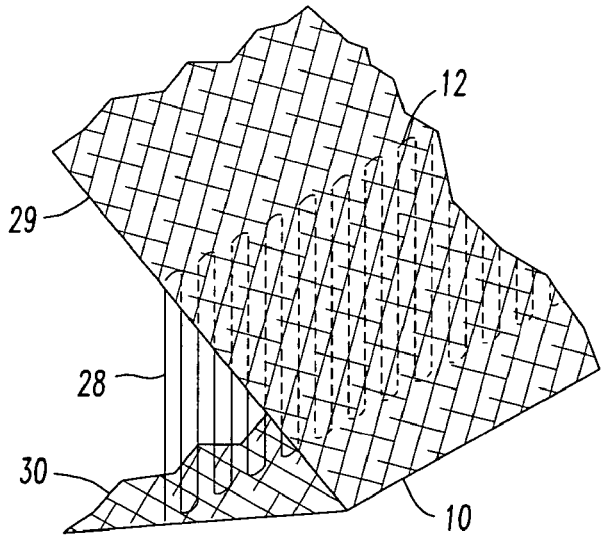
FIG. 4 is a greatly enlarged view of a front sewn in pleat in the embodiment of FIG. 1.
Figure 5:
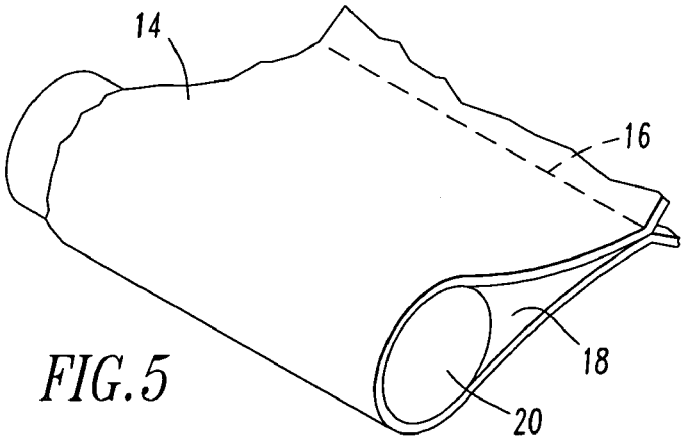
FIG. 5 is an enlarged view of a rear tab in the embodiment of FIG. 1.

A first present preferred embodiment of my pleated shade with sewn in pleats, shown in FIGS. 1 through 5, has a panel of pleated material 6 extending between a headrail 2 and bottomrail 4. Lift cords 8 extend from the bottomrail into and through the headrail. As can be seen most clearly in FIGS. 2 and 3, a series of front pleats 10 extend outward from the front surface 11 of the panel of material 6. A front seam 12 is sewn into the panel of material 6 to form the front pleats. I prefer that the seam be positioned so that there is not more than one sixteenth of an inch of material between the seam and the fold at the outermost portion of the pleat. A tight seam may create a small tab of about one sixteenth of an inch or less that is imperceptible when the shade is viewed from a distance of at few feet. Such a small tab will appear to be a fold rather than a tab when the shade is hung on a window and seen from a distance. In many fabrics the number of threads within the small tab will be only about a dozen threads. Although it is possible in theory to use glue to form this small tab, in practice it is quite difficult to control the glue applicator in a production process so that only a small amount of glue is evenly applied to create small tabs of consistent width throughout the panels. Sewing provides consistent results. This seam will create a pleat in fabric without treating or ironing the fabric to retain a pleat in the material. Consequently, the panel of material 6 can be a lace or other fabric which cannot be ironed or which may discolor when coated or ironed. Indeed, the panel of material 6 is not ironed and preferably is not coated or otherwise chemically treated to retain the pleats. As a result, the material has a softer appearance than most pleated shades. The thread 28 which forms this seam may be loosely threaded through the upper portion 29 of the pleat and the lower portion 30 of the pleat such that the two portions do not abut one another. Instead, as can be seen in FIG. 4, there is a space between the upper portion 29 and lower portion 30 adjacent the thread 28. The seam could be sufficiently loose so that the pleat is rounded and may even be hemispherical. While the sewn in pleat provides an accordion effect to the material, the front panel is not as sharp as conventional pleats. The rounder, softer appearance is the result of the absence of pleat retention coatings and lack of ironing.

One could also provide the same type of sewn-in pleats in the back face of the panel. However, if the material is pleated in this way, it would be unnecessary to drill holes through the fabric through which the lift cords may pass. Consequently, I prefer to provide larger tabs on the rear surface which can be gripped by clips which receive the lift cords.

A second set of seams 16 is provided to create a series of tabs 14 extending from the back surface 13 of the panel of material. As can be seen most clearly in FIGS. 3 and 5, seam 16 is positioned to create a pocket 18 and a stiff or flexible rod 20 is preferably inserted into the pocket. Tabs 14 preferably about one fourth inch in width, but could be one half inch or larger. The rod 20 has a diameter of about one eight inch. A first set of clips 22, shown in FIG. 3, fits onto the tabs. These clips have an eyelet 23 through which the lift cord 8 may freely pass. Also provided is a spacer cord 24. A second set of clips 26 is attached to the spacer cord such that the clips are equally spaced and cannot move relative to the spacer cord 24. These clips 26 also fit onto the tabs 14 as shown in FIG. 3. The distance between adjacent clips will determine the spacing between adjacent front pleats and adjacent rear pleats or tabs. In the figures each tab is formed in one panel of material. However, two panels or panel segments could be joined at a tab to form the panel of material 6. The seam may be positioned such that the two segments or portions of the panel of fabric overlap at the seam. Moreover, the seam may be such that the two portions of material can be pulled apart from one another without breaking the seam.

The size of the pleats as measured by the distance between a front pleat and an adjacent rear tab 14 preferably is one and one-half inch. However, the pleats may range in size from three eights to five inches.

The use of sewn in pleats as disclosed here permits one to use panels of open weave materials such as lace, which does not retain enough pleat retention coating to be easily pleated by a conventional process. Furthermore, the shape of the pleats may be more rounded or softer depending upon the distance between the seam and the outer most edge of the pleats. Consequently, pleats of different shapes can be made in the same or similar materials by repositioning the seam relative to the nose of the pleat, and adjusting the looseness of the seam.

I prefer to use soft materials of the type used for drapery. But, one could use lace, sheers, cotton, cotton blends, polyester knitted fabric and polyester woven fabric for the panel of material. The thread used to make the seams usually will be the same color and composition as the fabric. But one could use different colors or types of threads to highlight the seams.

To make the pleated material here disclosed one would select a panel of fabric and accordion fold the panel. Then seams are sewn in the front set of folds to hold the pleats. The seams may be tight to create small tabs or, the seams could be loose to create a rounded or hemispherical fold. Next seams are sewn adjacent the rear folds to create tabs of about one fourth to one half inch in width. Each of these tabs should open to form a pocket into which a stiff or flexible rod is inserted. Clips are then attached over the tabs with rods to receive a lift cord. Spacer cords may also be attached to these tabs with a second set of clips. The spacer cords preferably maintain a distance of about two inches between front tabs. Although I prefer to use spacer cords, the use of spacer cords is not required.

In the preferred embodiments the lift cords pass through clips attached to the rear tabs. However, the lift cords could pass through holes provided in the rear tabs or through holes in the panel of fabric.

Although I have shown and illustrated certain present preferred embodiments of my pleated shade with sewn in pleats, it is to be distinctly understood that the invention is not limited thereto, but may be variously embodied within the scope of the following claims.

I claim:

1. A material for a pleated shade apparatus, the material comprising:

a panel of fabric having a front side and a back side;

a first set of seams sewn through the panel at spaced apart locations in a manner to create a plurality of tabs extending from the back side of the panel of fabric; and a second set of seams sewn through the panel of fabric such that there is one seam from the second set of seams between each pair of adjacent seams from the first set of seams, each seam from the second set of seams positioned to form a pleat extending outward from the front side of the panel of fabric so that there is not more than one sixteenth of an inch of fabric between the seam and an outermost portion of the pleat.

2. The material of claim 1 also comprising a pocket in each tab that extends from the back side.

3. The material of claim 2 also comprising a rod in each pocket.

4. The material of claim 1 wherein adjacent fabric segments are joined together in a tab.

5. The material of claim 1 wherein at least one seam of the second set of seams is sewn such that two portions of the panel of fabric overlap the at least one seam and the two portions of material can be pulled apart from one another without breaking the at least one seam.

6. The material of claim 1 also comprising at least one spacer device attached to the tabs.

7. The material of claim 1 wherein the panel of fabric is a material selected from the group of materials consisting of lace, sheers, cotton, cotton blends, polyester knitted fabric and polyester woven fabric.

8. The material of claim 1 wherein the fabric is free of pleat retaining coatings.

9. The material of claim 1 A material for a pleated shade apparatus, the material comprising:

a panel of fabric having a front side and a back side;

a first set of seams sewn through the panel at spaced apart locations in a manner to create a plurality of tabs extending from the back side of the panel of fabric; and a second set of seams sewn through the panel of fabric such that there is one seam from the second set of seams between each pair of adjacent seams from the first set of seams, each seam from the second set of seams positioned to form a pleat extending outward from the front side of the panel of fabric;

wherein at least one the seam in the second set of seams is loosely threaded so that an upper portion of the pleat adjacent the seam does not abut a lower portion of the pleat adjacent the seam.

10. A material for a pleated shade apparatus, the material comprising:

a panel of fabric having a front side and a back side and free of any pleat retaining coatings;

a first set of seams sewn through the panel at spaced apart locations in a manner to create a plurality of pleats extending outward from the back side of the panel of fabric; and a second set of seams sewn through the panel of fabric such that there is one seam from the second set of seams between each pair of adjacent seams from the first set of seams, each seam from the second set of seams forming a pleat extending outward from the front side of the panel of fabric, each pleat extending outward from the front side of the panel of fabric having an outermost portion, each seam of the second set of seams being sewn on the outermost portion of a pleat extending outward from the front side of the panel of fabric such that no tab extends beyond a seam of the second set of seams.

11. The material of claim 10 wherein at least one seam of the second set of seams is sewn such that two portions of the panel of fabric overlap the at least one seam and the two portions of material can be pulled apart from one another without breaking the at least one seam.

12. The material of claim 10 wherein the panel of fabric is a material selected from the group of materials consisting of lace, sheers, cotton, cotton blends, polyester knitted fabric and polyester woven fabric.

13. A pleated shade comprising:

a headrail;

a bottomrail;

a panel of fabric having a front side and a back side, the panel of fabric extending from the headrail to the bottomrail;

a first set of seams sewn through the panel at spaced apart locations in a manner to create a plurality of tabs extending from the back side of the panel of fabric;

a second set of seams sewn through the panel of fabric such that there is one seam from the second set of seams between each pair of adjacent seams from the first set of seams, each seam from the second set of seams positioned to form a pleat extending outward from the front side of the panel of fabric so that there is not more than one sixteenth of an inch of fabric between the seam and an outermost portion of the pleat; and a plurality of lift cords extending from the bottomrail into the headrail.

14. The pleated shade of claim 13 also comprising a pocket in each tab that extends from the back side.

15. The pleated shade of claim 14 also comprising a rod in each pocket.

16. The pleated shade of claim 13 wherein adjacent fabric segments are joined together in a tab.

17. The pleated shade of claim 13 wherein at least one seam of the second set of seams is sewn such that two portions of the panel of fabric overlap the at least one seam and the two portions of material can be pulled apart from one another without breaking the at least one seam.

18. The pleated shade of claim 13 also comprising at least one spacer device attached to the tabs that extend from the back side.

19. The pleated shade of claim 13 wherein the panel of fabric is a material selected from the group of materials consisting of lace, sheers, cotton, cotton blends, polyester knitted fabric and polyester woven fabric.

20. The pleated shade of claim 13 wherein the fabric is free of pleat retaining coatings.

21. A pleated shade comprising:

a headrail;

a bottomrail;

a panel of fabric having a front side and a back side, the panel of fabric extending from the headrail to the bottomrail;

a first set of seams sewn through the panel at spaced apart locations in a manner to create a plurality of tabs extending from the back side of the panel of fabric;

a second set of seams sewn through the panel of fabric such that there is one seam from the second set of seams between each pair of adjacent seams from the first set of seams, each seam from the second set of seams positioned to form a pleat extending outward from the front side of the panel of fabric; and a plurality of lift cords extending from the bottomrail into the headrail;

wherein at least one the seam in the second set of seams is loosely threaded so that an upper portion of the pleat adjacent the seam does not abut a lower portion of the pleat adjacent the seam.

22. A pleated shade comprising:

a headrail;

a bottomrail;

a plurality of lift cords extending from the bottomrail into the headrail.

a panel of fabric having a front side and a back side and free of any pleat retaining coatings;

a first set of seams sewn through the panel at spaced apart locations in a manner to create a plurality of pleats extending outward from the back side of the panel of fabric; and a second set of seams sewn through the panel of fabric such that there is one seam from the second set of seams between each pair of adjacent seams from the first set of seams, each seam from the second set of seams forming a pleat extending outward from the front side of the panel of fabric, each pleat extending outward from the front side of the panel of fabric having an outermost portion, each seam of the second set of seams being sewn on the outermost portion of a pleat extending outward from the front side of the panel of fabric such that no tab extends beyond a seam of the second set of seams.

23. The pleated shade of claim 22 wherein at least one seam of the second set of seams is sewn such that two portions of the panel of fabric overlap the at least one seam and the two portions of material can be pulled apart from one another without breaking the at least one seam.

24. The pleated shade of claim 22 wherein the panel of fabric is a material selected from the group of materials consisting of lace, sheers, cotton, cotton blends, polyester knitted fabric and polyester woven fabric.

25. A pleated shade comprising:

a headrail;

a bottomrail;

a plurality of lift cords extending from the bottomrail into the headrail.

a panel of fabric having a front side and a back side and free of any pleat retaining coatings;

a first set of seams sewn through the panel at spaced apart locations in a manner to create a plurality of pleats extending outward from the back side of the panel of fabric; and a second set of seams sewn through the panel of fabric such that there is one seam from the second set of seams between each pair of adjacent seams from the first set of seams, each seam from the second set of seams forming a pleat extending outward from the front side of the panel of fabric;

wherein at least one the seam in the second set of seams is loosely threaded so that an upper portion of the pleat adjacent the seam does not abut a lower portion of the pleat adjacent the seam.

* * * * *

UNITED STATES PATENT AND TRADEMARK OFFICE

CERTIFICATE OF CORRECTION

PATENT NO. : 7,243,698 B2
APPLICATION NO. : 11/032818
DATED : July 17, 2007
INVENTOR(S) : Leonard Siegel It is certified that error appears in the above-identified patent and that said Letters Patent is hereby corrected as shown below:

Column 4, claim 9, line 62, delete "The material of claim 1".

Signed and Sealed this

Twenty-fifth Day of December, 2007

JON W. DUDAS
*Director of the United States Patent and Trademark Office*